United States Patent [19]

Foster

[11] 4,205,568

[45] Jun. 3, 1980

[54] METHOD AND APPARATUS FOR OPTIMIZING EDGE CUT OF BOARDS FROM CANTS AND THE LIKE

[75] Inventor: Theodore C. Foster, Eugene, Oreg.

[73] Assignee: Far West Equipment & Control Corp., Eugene, Oreg.

[21] Appl. No.: 890,050

[22] Filed: Mar. 27, 1978

[51] Int. Cl.[2] ..... B27B 5/04; B27B 31/06

[52] U.S. Cl. ..... 83/71; 144/312; 83/425.2; 83/367

[58] Field of Search ..... 83/71, 365, 367, 425.2, 83/425.4, 425.3; 144/312

[56] References Cited

U.S. PATENT DOCUMENTS

| | | | |
|---|---|---|---|
| 3,890,509 | 6/1975 | Maxy | 144/312 X |
| 3,963,938 | 6/1976 | Sanglert | 144/312 X |
| 3,970,128 | 7/1976 | Kohlberg | 144/312 X |
| 3,983,403 | 9/1976 | Dahlstrom et al. | 144/312 X |
| 4,086,496 | 4/1978 | Berry | 144/312 X |

*Primary Examiner*—Donald R. Schran
*Attorney, Agent, or Firm*—Eugene D. Farley

[57] ABSTRACT

Cants from logs are conveyed transversely to their length to measure the cant thickness and position of the upper surface by passing under a thickness detector that directs the vertical positioning of a plurality of linearly spaced proximity edge sensors. The cant passing a sensor causes a series of pulses related to the conveyor speed to be introduced into a computer to measure the width of the cant at each of the sensor positions. The computer determines the alignment of the linear axis of the cant to yield the maximum board volume and directs the positioning of the cant relative to edging saws and transfer of the cant to a longitudinal conveyor for feed into the edging saws.

The apparatus employed comprises a frame supporting a conveyor having its travel transverse to the length of the cant to be transported and a plurality of upper and lower proximity edge sensors linearly spaced parallel to the length of the cant. The upper sensors are adapted to be vertically positioned relative to the upper surface of the cant as established by a thickness detector positioned upstream of the edge sensors. As the leading edge of the cant passes a sensor a series of electrical pulses is initiated to a computer for that sensor and as the trailing edge passes the sensor terminates the pulses, thereby establishing the cant width at each sensor position. The computer determines maximum cant yield and directs positioning heads to position the cant in relation to edging saws for transfer to a longitudinal conveyor for feeding into the edging saws.

10 Claims, 27 Drawing Figures

METHOD AND APPARATUS FOR OPTIMIZING EDGE CUT OF BOARDS FROM CANTS AND THE LIKE

BACKGROUND AND GENERAL STATEMENT OF THE INVENTION

My invention pertains to a method and apparatus for determining and positioning a cant in relation to edging saws or cutters, chippers, or band saws to optimize the yield from the cant.

In the lumber industry it has been common practice to control the position of a cant on a slat bed conveyor feeding edging saws by visual evaluation of an operator, after which the cant is fed into the edging saws. This practice results in low yield from the cant or boards with excessive wane resulting in scrap. Production rate is controlled by the ability of the operator to judge and set the cant relative to the edging saws.

Sorenson U.S. Pat. No. 2,111,699 discloses the use of mechanical fingers to determine cant edge contour and direct positioning of the cant on the conveyor feeding edging saws. Barr et al U.S. Pat. No. 3,931,501 discloses photoelectric cell sensors for surface defect detection by passing the detectors longitudinally over the work piece lengths.

The manual positioning of the cant in relation to the edging saws is slow and tedious and subject to operator mistakes. The mechanical determination of the edge contour does not provide for determination of the maximum yield that can be obtained from a given cant. It is the general object of the present invention to provide a method and apparatus which will achieve the purpose of determining the maximum useable material from a cant and directing the positioning of that cant in relation to edging saws.

Another object of this invention is the provision of equipment that will determine maximum cant yield at a high rate of speed.

Another object of this invention is to provide for edge sensing that is not affected by color.

Another object of this invention is to provide cant edge sensing that is not affected by normal vibration, dust and dirt.

Another object of this invention is to provide cant edge sensing units requiring a minimum of space.

Another object of this invention is to provide cant edge sensors that are accurate independent of the cant surface that faces upwardly.

Another object of this invention is to provide cant edge sensors that will sense the surface edge of center cants.

Another object of this invention is to determine the maximum production from a given cant and position the cant in relation to edging saws to yield that production.

Another object of this invention is the provision of equipment that is highly accurate.

Broadly considered the foregoing and other objects of this invention are accomplished by a method which comprises positioning a plurality of proximity sensors relative to the surface of a cant, conveying the cant past the sensors encoding a series of pulses into a computer during the time the cant is passing the sensors, determining the position to set the cant relative to edging saws to optimize cant yield, directing a pair of positioning heads to position the cant in relation to the edging saws and transferring the cant to a longitudinal conveyor for feeding the edging saws.

The objects of the invention are further achieved by providing an apparatus for accomplishing the foregoing functions.

DESCRIPTION OF SPECIFIC EMBODIMENTS OF THE INVENTION

Figures 1, 2, 3, 4, 5, 6, 7, 8, 9, 10, 11, 12, 13, 14, 15:
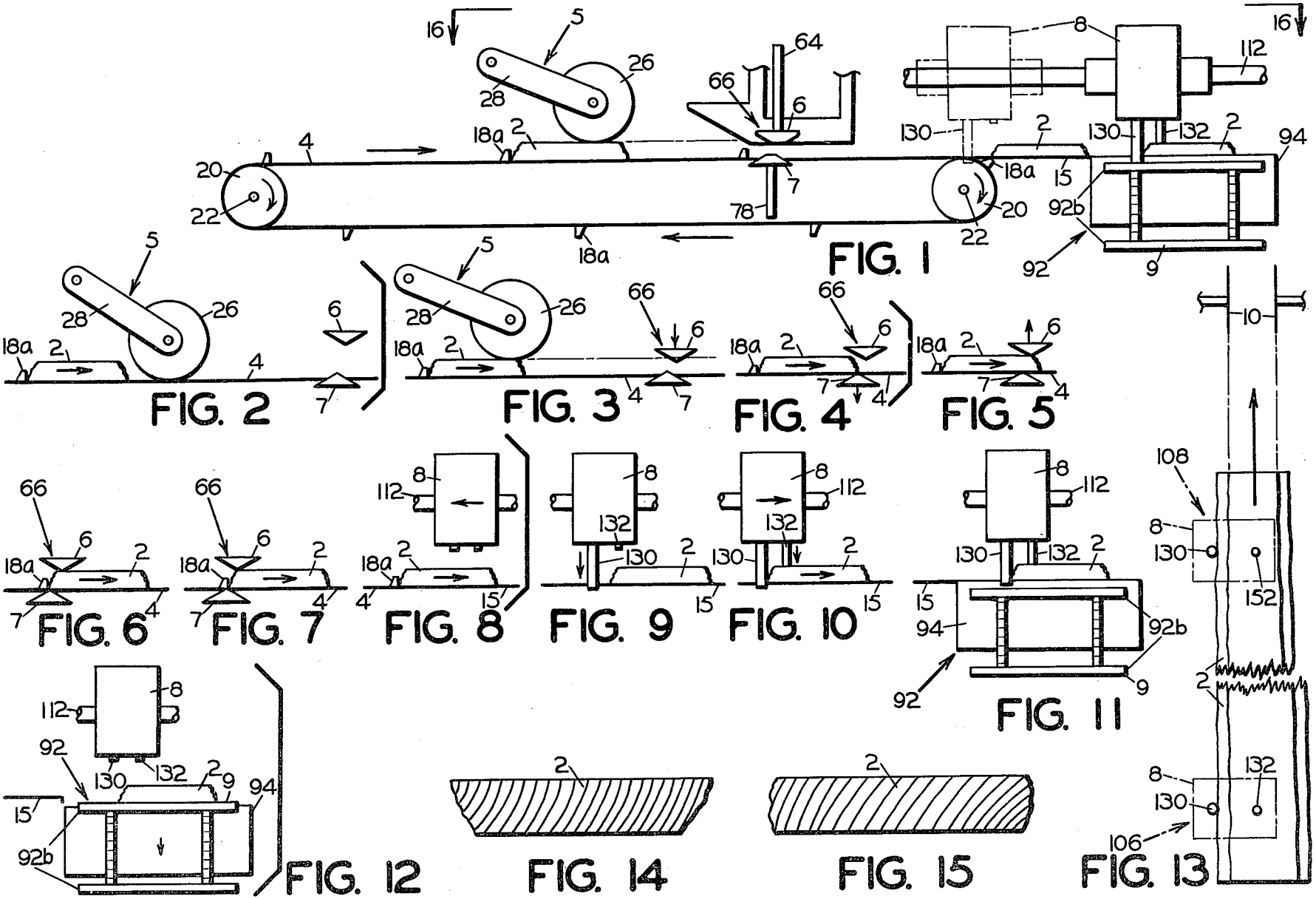
FIG. 1 is a schematic elevation view showing the functional elements.
FIGS. 2 through 13 are schematic illustrations of the functional steps.
FIGS. 14 and 15 are alternate configurations of the cant.

The principal sequence of events is illustrated in FIGS. 1 through 13 in which the cant 2 is positioned on a feed conveyor 4 FIGS. 1 and 2, measuring the thickness by a thickness detector 5 and positioning proximity sensor units 6 relative to the cant surface, FIG. 3, conveying the cant 2 past lower and upper sensors 7 and 6 respectively sensing the lower and upper cant leading edges FIGS. 4 and 5 to initiate a series of pulses to a computer and sensing the lower and upper cant trailing edges FIGS. 6 and 7 to stop the pulses thereby determining the cant width. The computer determines optimum cant yield for the cant thickness and width as positioning heads 8 return to the discharge of the feed conveyor 4 FIG. 8. The computer directs the positioning heads to lower pusher pins 130 FIG. 9 and hold down pins 132 FIG. 10, position the cant 2 relative to longitudinal conveyor 9 FIG. 11, withdraw pusher pins and hold down pins FIG. 12 and transfer the cant to the longitudinal conveyor 9 FIG. 12 for feeding into edging saws 10 FIG. 13.

Figure 16:
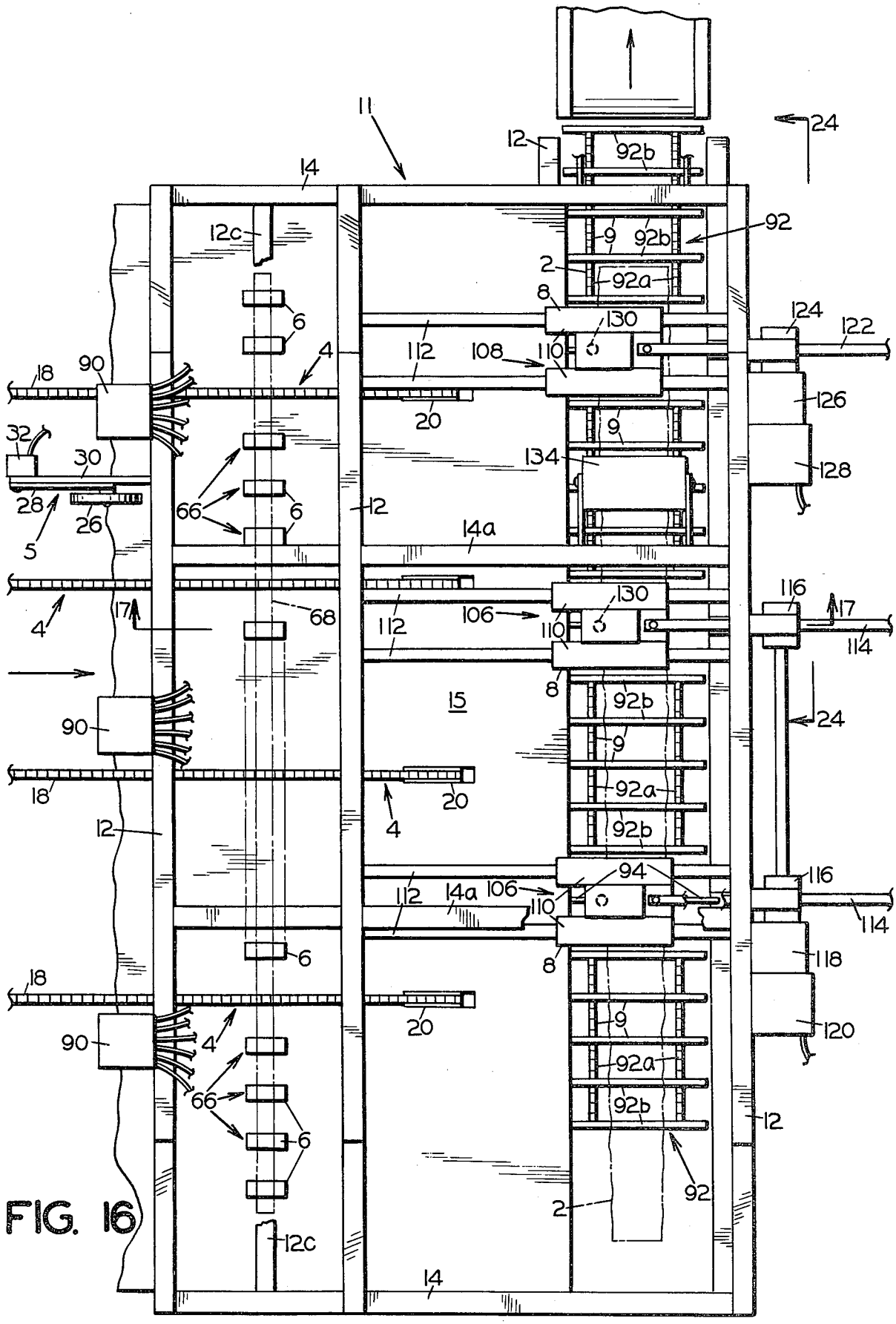
FIG. 16 is a plan view along the line 16—16 of FIG. 1.
Figure 17A:
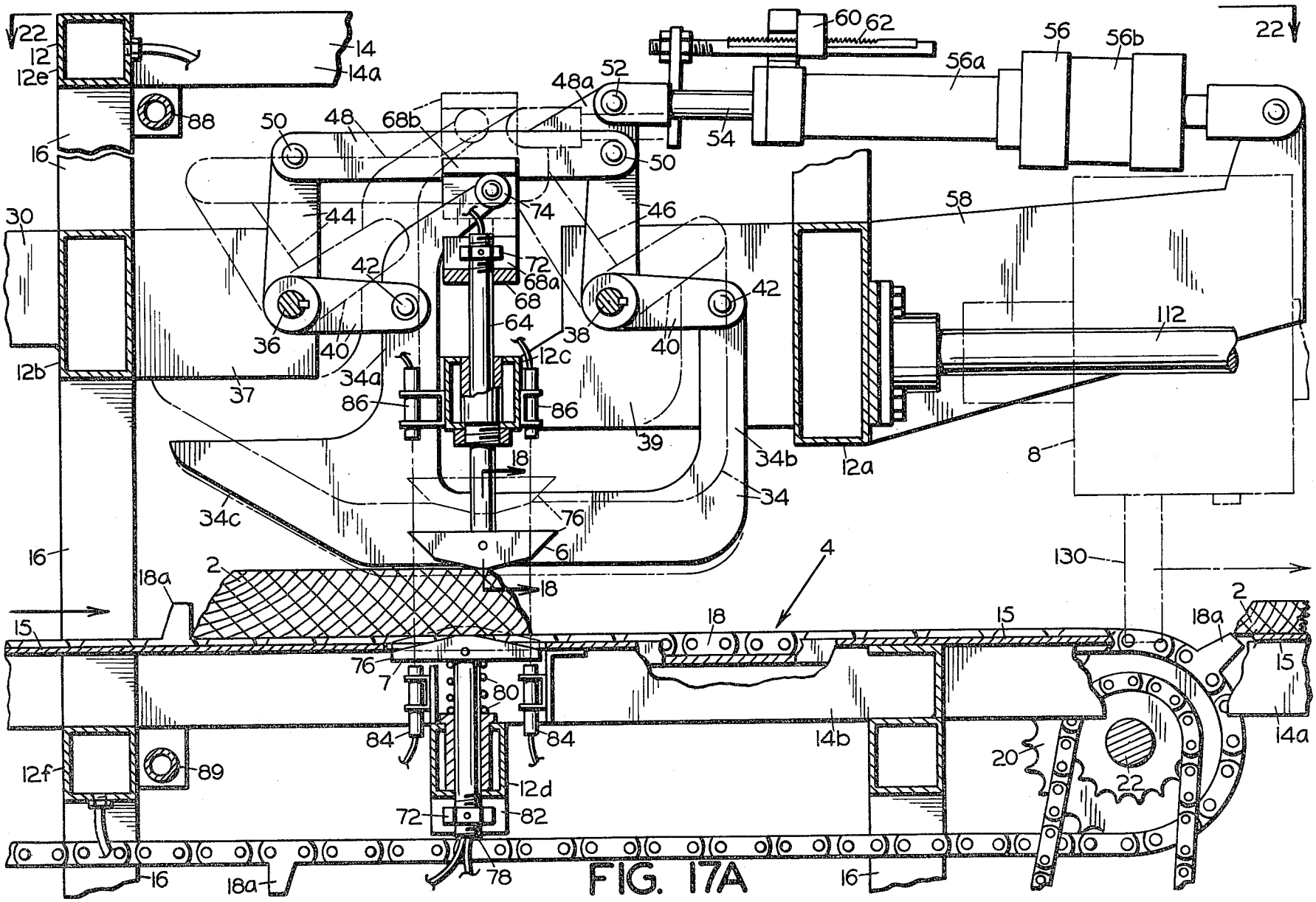
FIGS. 17A and 17B are sectional elevation views taken along the line 17—17 of FIG. 16.
Figure 17B:
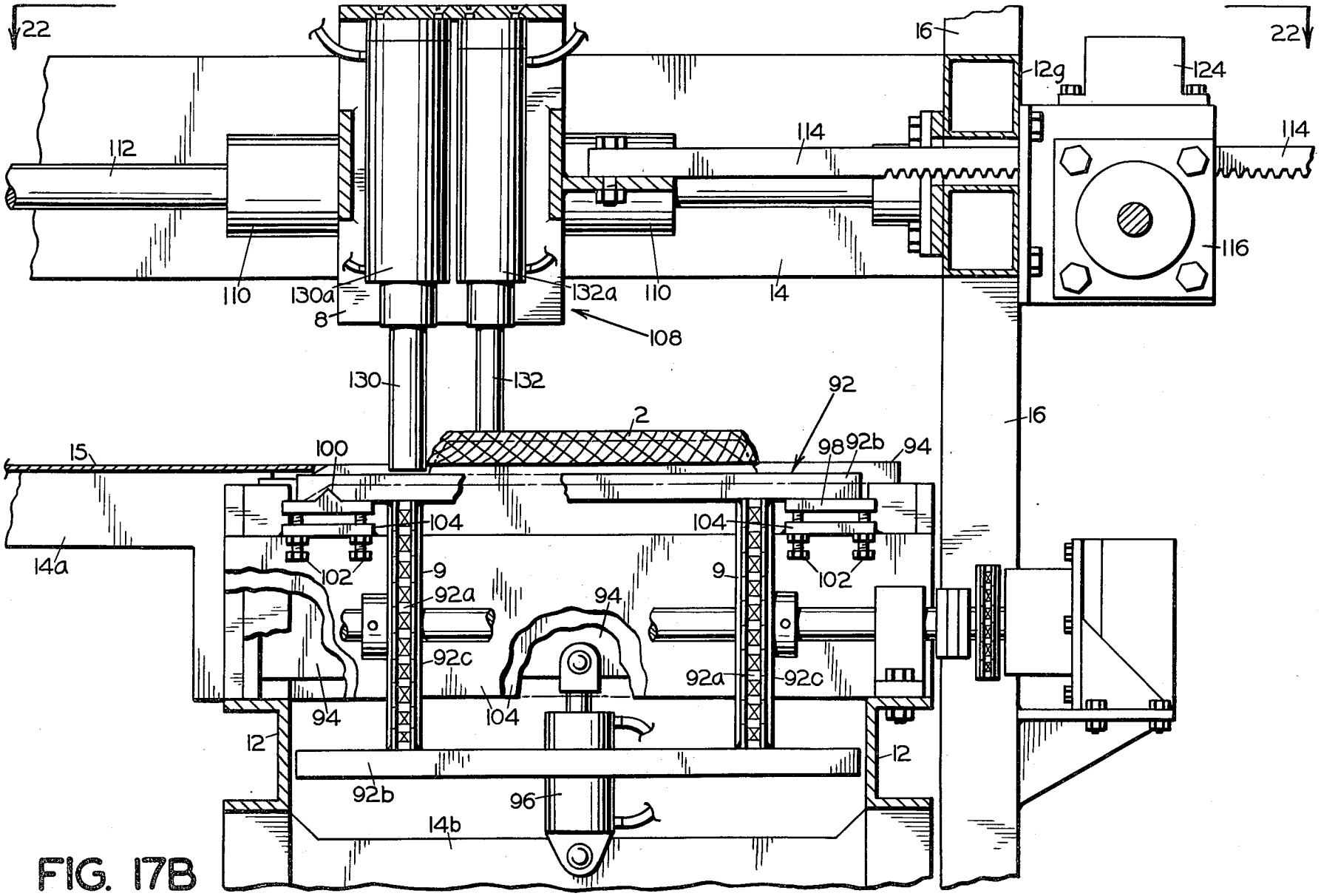

The apparatus, with particular reference to the drawings, to accomplish the sequence is supported on a frame 11 FIG. 16 having longitudinal members 12, transverse members 14 and vertical members 16 FIGS. 17A and 17B. The apparatus supported by the frame comprises the following.

A. CANT VOLUME MEASUREMENT

The feed conveyor 4 FIGS. 16 and 17A comprises a plurality of parallel chains 18 driven by sprockets 20 supported on a common shaft 22 driven by a hydraulic motor, not shown. The chains 18 are provided with spaced lug links 18a adapted to contact the trailing edge of the cant 2. A pulse generator 24 shown in block form in FIG. 26 comprises a timing belt driven by the feed conveyor drive thereby establishing a direct relation between the conveyor speed and the pulse intervals to be employed by the computer in determining the cant width.

Positioned above the feed conveyor is a thickness detector 5 FIG. 16 comprising a wheel 26 mounted on a pivoted arm 28 supported by bracket 30 from frame member 12b. Connected to the pivot shaft is a potentiometer 32.

Positioned between longitudinal frame members 12a and 12b FIG. 17A are longitudinally spaced hold down shoes 34 having upward extending arms 34a and 34b and an upward sloping forward edge 34c. Extending longitudinally between and parallel to frame members 12a and 12b are shafts 36 and 38 supported by frame brackets 37 and 39 respectively. Secured to the shafts 36 and 38 are lever arms 40. Pins 42 connect the lever arms 40 to the upward extending arms 34a and 34b of the shoes 34 providing support of the shoes by the shafts 36 and 38. Secured to the shafts 36 and 38 are upward extending arms 44 and 46 respectively, interconnected by link member 48 through pins 50, thereby producing vertical movement of the shoes 34 by movement of the link member 48. An upward extension 48a of the link member 48 provides for a pin connection 52 to the piston rod 54 of the cylinder assembly 56. The cylinder assembly 56 is pivotally supported at its opposite end on bracket 58 extending from longitudinal frame member 12a. Mounted on the cylinder assembly 56 is a position sensing potentiometer 60 actuated by rack 62 connected to piston rod 54. The potentiometer 60 functions in conjunction with potentiometer 32. The cylinder assembly 56 comprises a double acting hydraulic cylinder portion 56a and a single acting pneumatic portion 56b. The position of the piston rod 54 is directed by the signal of the thickness gauge potentiometer 32 thereby establishing the position of the lower edge of the shoes 34 relative to the upper surface of the cant 2, the shoes normally being positioned slightly above the upper cant surface. The pneumatic portion 56b of the cylinder assembly 56 provides a cushion in the event the shoes 34 are positioned below the cant surface.

Figures 18, 19, 20, 21, 22, 23:
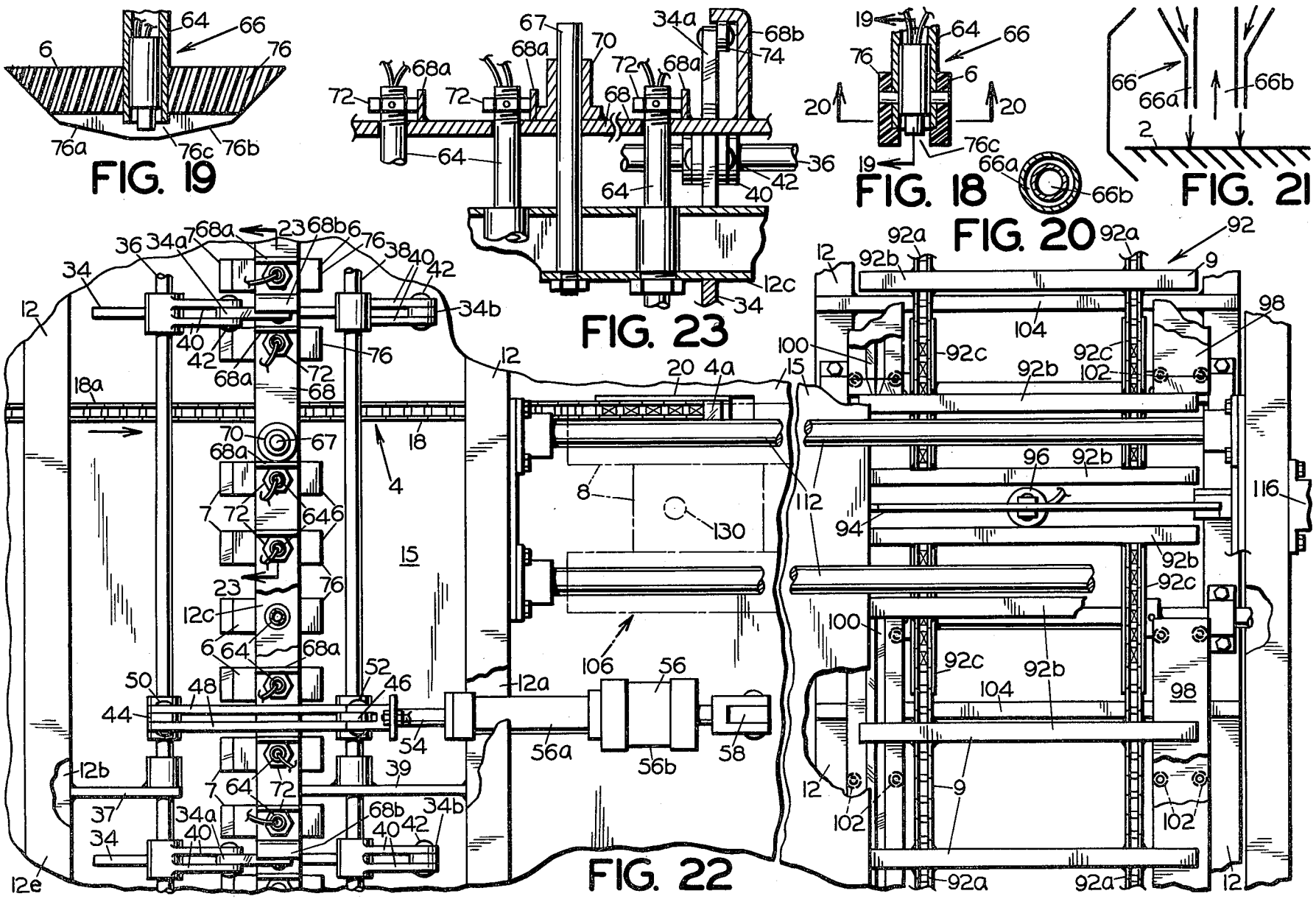
FIG. 18 is a fragmentary elevation view along the line 18—18 of FIG. 17A.
FIG. 19 is a fragmentary cross-section elevation along the line 19—19 of FIG. 18.
FIG. 20 is a partial cross-section along the line 20—20 of FIG. 18.
FIG. 21 is a schematic cross-section along the line 19—19 of FIG. 18.
FIG. 22 is a fragmentary plan view of the invention.
FIG. 23 is a fragmentary cross-sectional elevation along the line 23—23 of FIG. 22.

Slidably supported in longitudinal frame member 12c FIG. 17A are a plurality of sensor units 6 comprising a sensor tube 64 supporting in the lower end a pneumatic proximity sensor 66 FIG. 18. Projecting vertically from the longitudinal frame member 12c between the positions of the sensor tubes 64 are guides 67 FIGS. 22 and 23, which slideably position bar 68 having guide bushings 70. The upper end of each sensor tube 64 extends through clearance holes in the bar 68 and is provided with a vertical positioning nut 72 pinned to the sensor tube 64. Alignment of the sensor tubes 64 is provided by upward projecting members 68a positioned in close proximity to the flat side of the nuts 72. Nut adjustment is accomplished by raising the sensor tube so the nut 72 clears member 68a. The bar 68 is supported in its vertical position by angular bracket 68b in contact with wheel 74 on the upward extending arms 34a of the shoes 34, thereby fixing the relation of the sensor unit 6 relative to the shoes 34 between the passing of cants 2 under the sensor units.

Surrounding the lower end of each sensor tube 64 is a sensor shield 76 FIG. 19 having lower sloping surfaces 76a and 76b which provide for the cant to raise the sensor tube as it contacts the shield 76. The shield 76 establishes the minimum space between the pneumatic proximity sensor 66 and the cant 2 surface. The sensor tube nut 72 is adjusted to permit the lowest point of the shield 76 to be below the lower surface of the shoes 34 by an amount that assures the shield contacting the cant. The clearance shown in FIG. 23 between the nut 72 and the bar 68 is the vertical rise of the sensor tube when the shield 76 is in engagement with the cant surface. The sensor unit maintains the shield in contact with the cant by gravity.

A plurality of lower sensor units 7 having a sensor tube 78 are slidably supported on lower longitudinal frame member 12d FIG. 17A. Mounted in the upper end of each sensor tube 78 is a pneumatic proximity sensor identical with the upper pneumatic proximity sensor 66, surrounded by identical shield 76. The vertical axis of sensor tubes 78 are offset from the vertical axis of sensor tubes 64 to avoid pneumatic flow interference The sensor tube 78 is supported vertically with the shields 76 held in contact with the cant 2 by compression spring 80. The maximum upward position is determined by the nut 72 positioned and pinned on the sensor tube 78. The sensor tube is held in alignment by the close proximity of the flat side of nut 72 with brackets 82 secured to the frame member 12d, as explained for the upper sensor tubes 64.

Mounted between a pair of sensor tubes 78 and positioned forward and rearward of the line of the sensor tubes are a pair of photoelectric cells 84 FIG. 17A. Aligned with and supported by longitudinal frame member 12c between a pair of upper sensor tubes 64 are light sources 86. These photoelectric cells function in coordination with the thickness detector potentiometer 32 and the shoes 34 positioning potentiometer 60 associated with cylinder 56 to control the vertical position of shoes 34 during the absence of a cant between sensor units 6 and 7.

The pneumatic proximity sensor 66 is a standard unit that functions as an edge sensor in my invention. A source of 6 psi air employing longitudinal frame members 12e and 12f FIG. 17A as a conduit and 3 psi air from pipes 88 and 89 are supplied to monitor units 90 FIGS. 16 and 26. Several sensors 66 are provided with air and monitored from each monitor unit. The 6 psi air flows from annular orifice 66a FIG. 21. The three psi air flows from center orifice 66b. The orifices are vertically spaced from the cant surface by the shield 76 provided with a relief slot 76c. When the edge of the cant interferes with air flow from the annular orifice 66a a back pressure is developed in the center orifice 66b causing an increase in the 3 psi pressure. The increase in pressure causes an electrical signal to the computer FIG. 26 to begin register of the pulses from the pulse generator 24, previously mentioned. Recording of pulses by the computer are stopped when the sensor air flow is no longer interferred with thereby permitting the computer to establish cant width at each sensor position.

Figure 26:
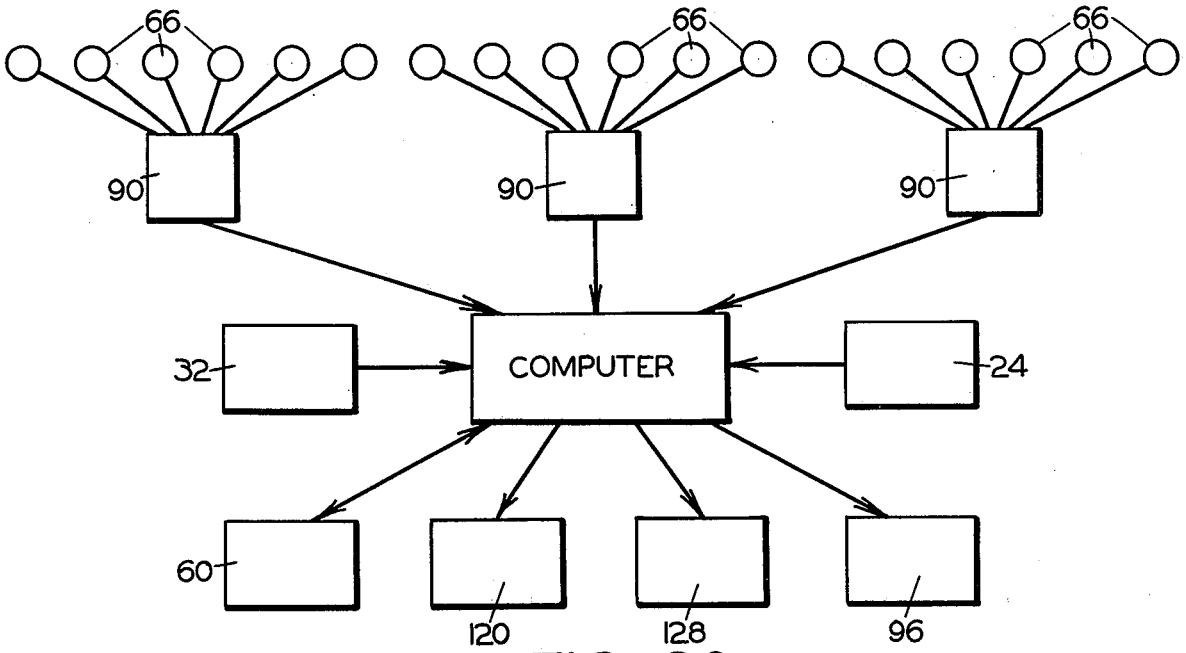
FIG. 26 is a block diagram illustrating the electrical computer interties.

During the remaining travel time of the cant 2 on conveyor chains 18 the computer FIG. 26 combines the information from the thickness detector potentiometer 32 and the sensor units 6 and 7 to determine the edge cut that will produce maximum cant yield.

B. CANT EDGER SAW ALIGNMENT

Transverse frame members 14a FIGS. 16, 17A and 17B provide skid surfaces on the plane of the upper edge of conveyor chains 18 onto which the cant 2 is discharged.

The longitudinal conveyor 9 FIG. 11 comprises a series of slat bar conveyors 92 FIGS. 16, 17B, 22 and 24 having their travel transverse to conveyor chains 18 and spaced from the discharge end of conveyor chains 18 with the top of the slat bars below the upper surface of chains 18 and frame members 14*a*. Between the slat bar conveyors and transverse to the conveyor travel are lift skids 94. The lift skids 94 are slidably supported in frame slots and raised and lowered by double-acting pneumatic cylinders 96 supported on transverse frame member 14*b*. In the raised position the upper edge of the lift skid 94 becomes an extension of the upper surface 15 of the frame members 14*a*.

Figure 24:
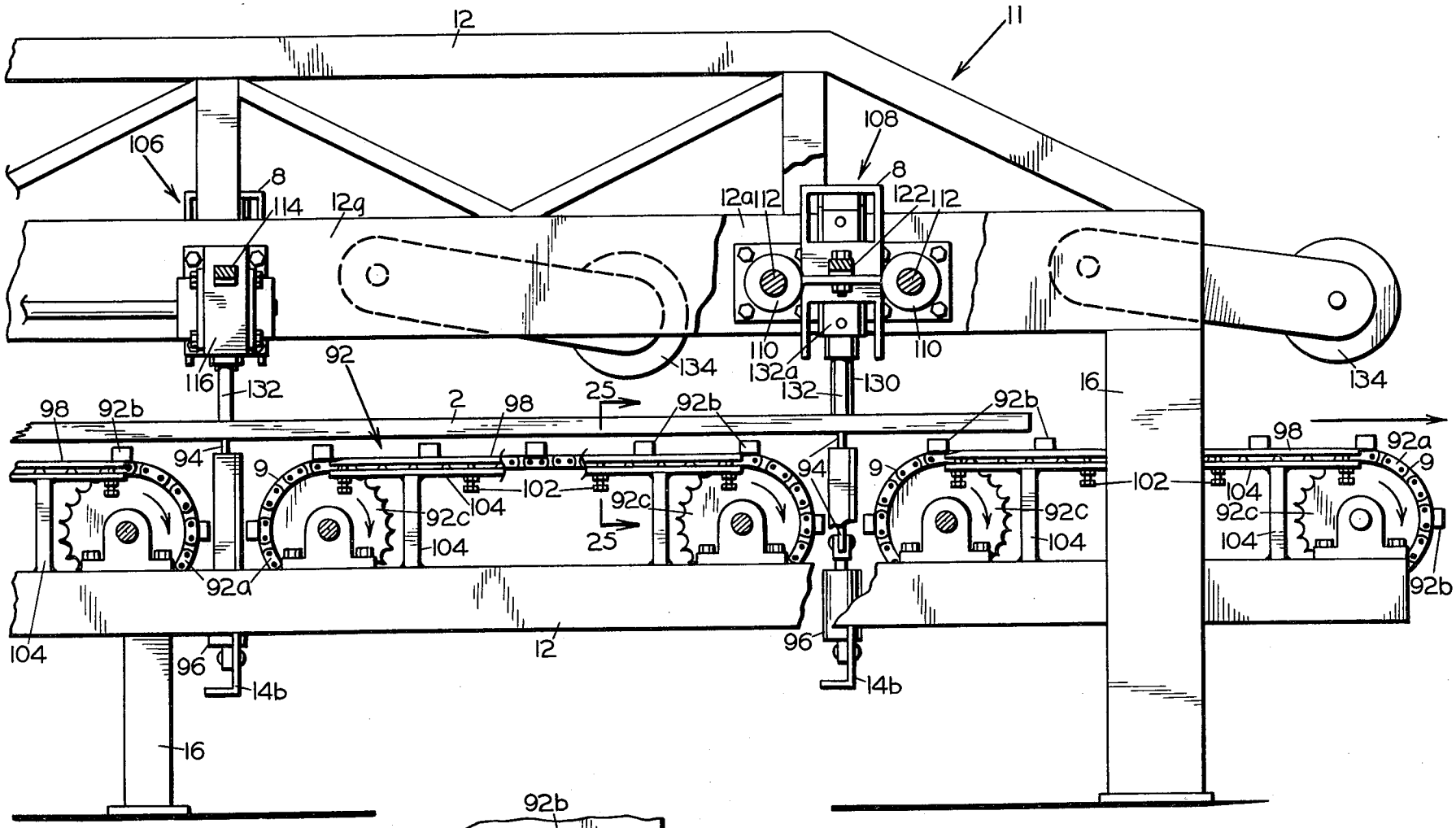
FIG. 24 is a fragmentary elevation along the line 24—24 of FIG. 16.
Figure 25:
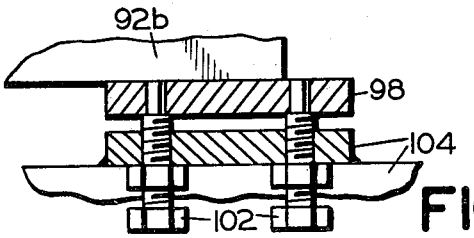
FIG. 25 is a fragmentary cross-section elevation along the line 25—25 of FIG. 24.

Each slat bar conveyor comprises a pair of chains 92*a* FIGS. 16, 17B and 24 to which the slat bars 92*b* are attached. The chains 92*a* are supported on and driven by sprockets 92*c* driven by variable speed hydraulic motor, not shown. During the upper horizontal travel the slat bars 92*b* are supported on skids 98 and 100. The skids are adjusted vertically by the screws 102 threaded through bars 104 attached to frame members FIG. 25. The skids 100 are provided with an inverted V FIG. 17B to engage an inverted V-notch in the lower side of slat bars 92*b* to assure straight travel of the slat bars. The several sets of slat bar conveyors function as longitudinal conveyor 9 for the cant 2 to be fed into the edging saws 10.

Slidably supported above the conveyor chains 18, surface 15, and conveyors 92 are positioning heads 8 FIG. 9 comprising identical positioning heads 106 and positioning head 108 FIGS. 16, 17B and 24. The positioning heads are provided with guide bearings 110 to slidably support the positioning heads on guide rods 112 attached at their ends to longitudinal frame members 12*a* FIG. 17A and 12*g* FIG. 17B.

Positioning heads 106 are positioned along the guide bars 112 by racks 114 attached to the positioning heads and driven through gear boxes 116 by hydraulic motor 118 FIGS. 16 and 17B. Associated with the motor 118 is a logic unit 120 that controls the heads position.

Similarly, positioning head 108 is positioned by rack 122 driven through gear box 124 by hydraulic motor 126 controlled by logic unit 128 FIGS. 16 and 26.

Each positioning head is provided with a pusher pin 130 that engages the trailing edge of the cant and a hold down pin 132 that engages the upper surfaces of the cant. The pusher pins 130 are actuated by a double acting pneumatic cylinder 130*a* and hold down pins 132 are actuated by a double acting pneumatic cylinder 132*a*. The pusher and hold down pins of one of the positioning heads 106 are used in combination with the pusher and hold down pins of positioning head 108, the particular positioning head 106 to be used being determined by the cant length.

The positioning head 108 in combination with one of the positioning heads 106 position the cant 2 on lift skids 94 as directed by the computer to align the cant with the edger saws 10 FIG. 13. Hold down wheels 134 are pneumatically actuated to contact the cant after which the pusher pins 130 and hold down pins 132 are raised from the cant. The lift skids 94 are lowered transferring the cant to the slat bar conveyors 92.

C. OPERATION

In operation the cant 2 is placed on feed conveyor chains 18 with its longitudinal axis transverse to the travel of conveyor chains 18. The lugs 18*a* of conveyor chains 18 engage the trailing edge of the cant 2 transporting the cant under thickness detector wheel 26 FIGS. 1 and 16 changing the position of potentiometer 32 establishing an input to the computer FIG. 26 and initiating instructions to the hydraulic cylinder 56*a* to position shoes 34 relative to the cant 2 upper surface. The rack driven potentiometer 60 associated with shoe positioning cylinder 56 indicates the proper position of the shoes 34 to the computer and places the upper sensor tube 64 shield 76 in position to contact the upper cant surface.

The conveyor chains 18 transport the cant 2 between the upper and lower sensor tube shields 76 FIG. 17A causing sensors 66 to initiate a series of pulses, having a pulse interval related to the conveyor speed, to be counted by the computer for each of the sensor units 6 and 7.

As the trailing edges of the cant 2 are transported past the sensor units 6 and 7 the pulse counting recording is stopped, establishing the width of the upper and lower cant surfaces at each sensor unit.

The computer combines the information from the thickness detector potentiometer 32 with the cant width pulses and determines the alignment of the cant 2 with respect to the edging saws 10 for optimum cant yield as the cant 2 is pushed onto skid 15 by the conveyor chain lugs 18*a*.

The computer directs the logic units 120 and 128 FIGS. 16 and 26 to energize motors 118 and 126 to move the positioning heads to a position for lowering the pusher pins behind the trailing edge of cant 2. The computer then directs one of the positioning heads 106 and positioning head 108 to lower their respective pusher pins 130 behind the trailing edge of the cant 2 FIG. 17B. The computer then directs the position heads to move toward the slat bar conveyors 92 into contact with the trailing edge of the cant when the hold down pins 132 are energized to contact the upper cant 2 surface.

The computer through logic units 120 and 128 controlling motors 120 and 126 positions the cant 2 on lift skids 94 in alignment with the edging saws 10.

The computer directs the hold down wheels 134 to lower onto the cant and to raise pusher pins 130 and hold down pins 132 from the cant 2 and to lower lift skid 94 by energizing cylinder 96 transferring the cant 2 to the slat bar conveyors 92 which move the cant longitudinally into and through edging saws 10.

I claim:

1. Apparatus for positioning a cant relative to edging saws, comprising:

(a) feed conveyor means for transporting the cant transverse to the conveyor travel, (b) computer means for determining cant width, (c) a source of electric pulse signals, (d) a plurality of pneumatic edge sensors spaced apart laterally on lines substantially perpendicular to the direction of movement of the feed conveyor means and disposed above and below the cant support plane of said feed conveyor means for directing jets of air under pressure toward and substantially perpendicular to said cant support plane, said pneumatic edge sensors being operable upon impingement of air jets therefrom upon the leading edge of the confronting surface of a cant to initiate the delivery to the computer of electric pulse signals from the source thereof correlated with the rate of movement of the feed conveyor and upon passage of the trailing edge of the cant from said air jets to stop the delivery of said electric pulse signals to the computer, for determining the widths of the upper and lower surfaces of the cant, (e) longitudinal conveyor means for transporting the cant through edging saws, and (f) cant transport means operable by the computer for positioning the cant on the longitudinal conveyor means relative to the edging saws for obtaining maximum cant yield.

2. The apparatus of claim 1 including means supporting the upper line of the edge sensors for vertical adjustment relative to the cant support plane of the feed conveyor means and responsive to engagement with a cant on the feed conveyor means to adjust the upper line of edge sensors to a position closely adjacent the upper surface of a cant on the feed conveyor means.

3. The apparatus of claim 2 wherein the supporting means includes a plurality of hold-down shoes adjustable vertically with the upper line of edge sensors.

4. The apparatus of claim 2 wherein the supporting means includes a vertically movable frame mounting the upper line of edge sensors, power means engaging the frame for moving the latter, electrical control means for the power means having an electric circuit, variable resistance means in said electric circuit, a vertically movable cant thickness measuring member operatively coupled to the variable resistance means and operable upon engagement of a cant to adjust the variable resistance means to operate the power means to move the upper line of edge sensors to a position closely adjacent the upper surface of the cant.

5. The apparatus of claim 4 wherein the electric circuit of the variable resistance means also provides an input electric signal to the computer corresponding to the thickness of the cant.

6. The apparatus of claim 1 wherein each pneumatic edge sensor includes an air outlet and a shield projecting outward from the air outlet for engagement with the surface of a cant, whereby to space said air outlet a predetermined distance from said cant surface.

7. The apparatus of claim 1 including means supporting the upper line of edge sensors for vertical adjustment relative to the cant support plane of the feed conveyor means and responsive to engagement with a cant on the feed conveyor means to adjust the upper line of edge sensors to a position closely adjacent the upper surface of a cant on the feed conveyor means, the supporting means including a plurality of hold-down shoes adjustable vertically with the upper line of edge sensors, the supporting means also including a vertically movable frame mounting the upper line of edge sensors, power means engaging the frame for moving the latter, electrical control means for the power means having an electric circuit, variable resistance means in said electric circuit, a vertically movable cant thickness measuring member operatively coupled to the variable resistance means and operable upon engagement of a cant to adjust the variable resistance means to operate the power means to move the upper line of edge sensors to a position closely adjacent the upper surface of the cant, and wherein each associated pneumatic edge sensor includes an air outlet and a shield projecting outward from the air outlet and from the associated hold-down shoe for engagement with the surface of a cant, whereby to space said air outlet a predetermined distance from said cant surface.

8. The apparatus of claim 1 wherein the cant transport means comprises a cant lift member registering with the longitudinal conveyor means and movable vertically between an elevated position substantially at the cant support plane of the feed conveyor means and a lowered position below the cant support plane of the longitudinal conveyor means, and cant moving means arranged to move a cant from the feed conveyor means to the longitudinal conveyor means when the latter is in said elevated position.

9. The apparatus of claim 8 wherein the cant moving means comprises a plurality of pusher pins movable vertically for retractable engagement with a side edge of a cant at spaced intervals along the length of the latter, and power means engaging said pusher pins and operable to move said pins reciprocatively between the feed and longitudinal conveyor means for transporting a cant from the feed conveyor means to the longitudinal conveyor means.

10. The apparatus of claim 9 including a hold-down pin associated with and movable reciprocatively with each pusher pin, each hold-down pin being movable vertically for releasable engagement with the upper surface of a cant.

* * * * *